United States Patent [19]

Tjernstrom et al.

[11] 4,001,746

[45] Jan. 4, 1977

[54] DIRECT-COOLED TAPE LAYER WINDING

[75] Inventors: Ove Tjernstrom; Uno Zetterlund, both of Ludvika, Sweden

[73] Assignee: Asea, Vasteras, Sweden

[22] Filed: Mar. 27, 1975

[21] Appl. No.: 562,484

[30] Foreign Application Priority Data

Apr. 24, 1974 Sweden ..... 7405476

[52] U.S. Cl. ..... 336/62; 336/223

[51] Int. Cl.[2] ..... H01F 27/08

[58] Field of Search ..... 336/62, 223, 60, 55; 219/10.51; 310/54

[56] References Cited

UNITED STATES PATENTS

| | | | |
|---|---|---|---|
| 1,471,096 | 10/1923 | Brand | 336/62 |
| 3,878,492 | 4/1975 | Tjersteom | 336/62 |

FOREIGN PATENTS OR APPLICATIONS

| | | | |
|---|---|---|---|
| 180,000 | 7/1962 | Sweden | 336/62 |
| 219,605 | 3/1968 | Sweden | 336/62 |

*Primary Examiner*—Thomas J. Kozma

*Attorney, Agent, or Firm*—Watson, Cole, Grindle & Watson

[57] ABSTRACT

A direct-cooled layer winding for transformers is formed of a plurality of helically wound tapes, the tapes in successive layers being directed backwards and forwards in the axial direction so that the turns of successive layers form angles with each other. At least one cooling layer is arranged coaxial with the winding between two of the tape layers. The cooling layer is formed of a tubular cooling conductor which is helically wound into a complete layer with the inlet and outlet at the opposite ends of the winding.

1 Claim, 2 Drawing Figures

DIRECT-COOLED TAPE LAYER WINDING

BACKGROUND OF THE INVENTION

1. Field of the Invention

The present invention relates to a direct-cooled tape layer winding for transformers, reactors and the like.

2. The Prior Art

A tape layer winding with a conductor tape and a layer of insulation glued to each other will be very compact and frequently it is insufficient to provide cooling only on the outer sides of the winding. A number of cooling channels are then arranged in parallel with the axial direction of the winding by placing a number of axially arranged laths between two layers of the tape winding. An awkward disadvantage with these cooling channels is that a very unfavorable capacitive voltage drop occurs across such channels, and this is particularly pronounced in the case of shock stresses across the winding.

SUMMARY OF THE INVENTION

According to the invention, the above-mentioned drawback is eliminated by using axial cooling channels and by inserting cooling tubes in the winding and winding them in the same way as the conductor tape. The cooling tubes then constitute part of the winding. The cooling tubes are helically wound into a complete layer and have the inlet and outlet at opposite ends of the winding.

BRIEF DESCRIPTION OF THE DRAWINGS

The invention will be described with reference to the accompanying drawing in which.

DESCRIPTION OF THE PREFERRED EMBODIMENTS

Figure 1:
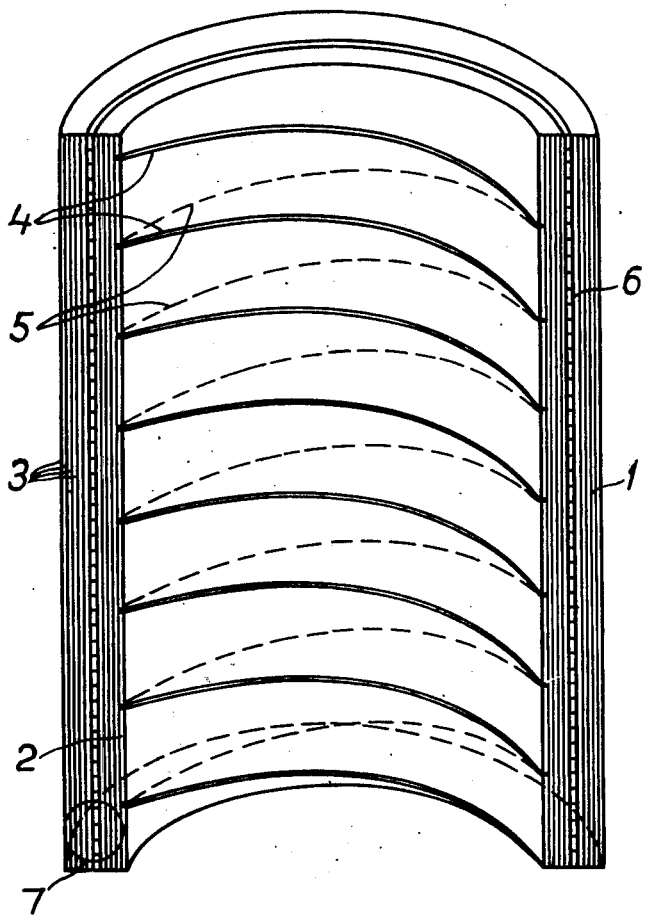
FIG. 1 shows an axial section through a tape layer winding with a cooling channel.

A tape layer winding 1 is manufactured by winding a tape 2 of copper or aluminium on a coil frame without overlap, thus forming a number of layers 3. The winding is performed backwards and forwards in the axial direction, so that the turns in two adjacent layers made a certain angle with each other. This is apparent from FIG. 1 where the continuous lines 4 show the turns in the innermost layer, whereas the broken lines 5 show the turns in the innermost layer but one.

Figure 2:
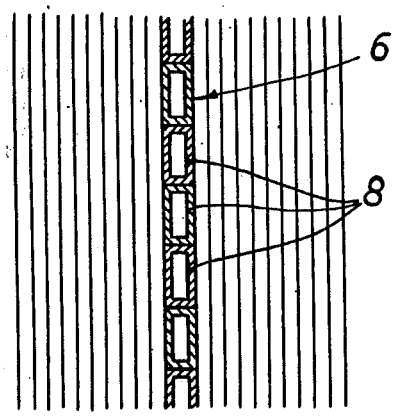
FIG. 2 shows part of the section on an enlarged scale.

The figures show how a cooling layer 6 is arranged inside the tape layer winding and FIG. 2 shows in detail an enlarged part 7 of the section in FIG. 1. The cooling layer is built up from a number of cooling tubes 8 of electrically conducting material, preferably with rectangular cross-section. A number of such cooling tubes are connected in a parallel bundle and are wound in an axial coil in the same way as the tape conductor. The bundle of cooling tubes is connected in series with the tape conductor, so that the cooling layer corresponds to a tape layer from an electrical point of view. If the number of parallel tubes in one tube bundle is chosen so that the width of the bundle is equal to the width of the tape, the same number of turns are obtained in the cooling layer as in one of the tape layers. The coolant is supplied to one end of the winding and is taken out at the other end. The number of parallel tubes in the cooling tube bundle is not necessarily chosen so that the cooling tube bundle has the same width as the tape, but can be chosen so that a sufficient flow of coolant with a reasonable fall of hydraulic pressure is obtained.

FIG. 1 shows one single cooling layer, but it goes without saying that two or more cooling layers can be inserted at varying radial distances.

We claim:

1. Direct-cooled tape layer winding for transformers, comprising a plurality of helically wound tape layers and at least one cooling layer (6) coaxial with the winding and arranged between two of the tape layers, said cooling layer having substantially the same total axial length as the winding, the cooling layer (6) being formed of a plurality of cooling tubes connected in a parallel bundle helically wound into a complete layer with the inlet and outlet of the cooling layer at the ends of the winding, the width of the tape being an integral multiple of the height of a plurality of cooling tubes of the cooling conductor.

* * * * *